United States Patent [19]

Maurer et al.

[11] Patent Number: 4,579,754

[45] Date of Patent: Apr. 1, 1986

[54] IDENTIFICATION CARD HAVING LASER INSCRIBED INDICIA AND A METHOD OF PRODUCING IT

[76] Inventors: Thomas Maurer, Apolloweg 12, Munich 60; Joseph Lass, Hiltenspergerstrasse 29, Munich 40; Hans-Jürgen Holbein, Thalkirchnerstrasse 68, Munich 2, all of Fed. Rep. of Germany, D-8000

[21] Appl. No.: 446,779

[22] Filed: Dec. 3, 1982

[30] Foreign Application Priority Data

Dec. 24, 1981 [DE] Fed. Rep. of Germany ..... 3151407

[51] Int. Cl.[4] ..... B42D 15/02

[52] U.S. Cl. ..... 428/29; 40/1.5; 40/2 R; 283/75; 428/76; 428/141; 428/195; 428/203; 428/204; 428/207; 428/211; 430/9; 430/10; 430/14

[58] Field of Search ..... 428/203, 211, 13, 29, 428/76, 141, 195, 204, 207; 427/7, 10; 430/9, 10, 11, 13, 14, 270, 945; 346/76 L, 135.1; 40/1.5, 2 R; 283/72, 75, 901, 904

[56] References Cited

U.S. PATENT DOCUMENTS

| | | | |
|---|---|---|---|
| 3,797,935 | 3/1974 | Marcy | 355/53 |
| 3,889,272 | 6/1975 | Lou et al. | 346/1 |
| 4,069,487 | 1/1978 | Kasai et al. | 346/76 L |
| 4,115,618 | 9/1978 | MacLeish et al. | 428/204 |
| 4,119,361 | 10/1978 | Greenaway | 350/1.1 |
| 4,304,981 | 12/1981 | Gappa | 219/121 LF |
| 4,316,073 | 2/1982 | Lemelson | 219/121 LC |
| 4,360,728 | 11/1982 | Drexler | 235/462 |

FOREIGN PATENT DOCUMENTS

| | | | |
|---|---|---|---|
| 2299972 | 8/1976 | France . | |
| 2044175 | 10/1980 | United Kingdom | 40/1.5 |

*Primary Examiner*—George F. Lesmes
*Assistant Examiner*—William M. Atkinson
*Attorney, Agent, or Firm*—Bacon & Thomas

[57] ABSTRACT

A multilayer identification card in which information in the form of patterns, letters, numbers and/or pictures is inscribed by means of a laser recorder in a laser transformable layer of the identification card which is made of plastic and is transparent in the visible spectral range.

The material of this laser transformable layer is adapted to the laser recorder in such a way that it absorbs the laser energy strongly enough in the wavelength of the laser beam transformations such as discoloration, microbubble formation, etc., take place locally in the material, rendering the applied information very clearly visible and immune to falsification in the otherwise transparent layer. This layer which bears the information can either be designed as a transparent identification card cover layer or be covered by another plastic layer which is transparent both visually and for the laser recorder.

16 Claims, 4 Drawing Figures

IDENTIFICATION CARD HAVING LASER INSCRIBED INDICIA AND A METHOD OF PRODUCING IT

FIELD OF THE INVENTION

The invention relates to a multilayer identification card with information in the form of patterns, letters, numbers and/or pictures, applied by means of a laser recorder, as well as a method of producing such identification cards.

BACKGROUND OF THE INVENTION

Identification cards in the form of credit cards, bank cards, cash payment cards and so on are increasingly used for cashless transfers in a great variety of service branches and also within enterprises. Due to their wide use, they are typically mass produced since, on the one hand—i.e. their production must be simple and inexpensive, and on the other hand, they must be designed in such a way that they are protected against forgery and falsification to as great an extent as possible. The many kinds of identification cards already on the market or still in the development phase indicate the efforts of the relevant industry to optimize the two abovementioned contradictory conditions.

In particular, it is necessary to protect the data relating to the card owner, which are applied to the identification card during so-called "personalization", in such a way that they cannot be subsequently manipulated. One possibility which has proved very useful in practice is to embed a paper inlay designed as a security print in a multilayer card. The paper inlay equipped with authenticity features such as watermarks, security threads, steel intaglio printing, etc., all used in the production of security documents, meets the highest standards of security and is protected against a great variety of types of attempted forgery and falsification, due to the protection of the data by means of transparent cover films.

Mainly because of their much more simple and inexpensive production, all-plastic identification cards are also used in the identification card field. The security inlay is replaced by a simple dyed film or the identification card data and the general printing are applied to the outer surface of a small plastic card, which may possibly have a multilayer construction.

In spite of their economic advantages, such all-plastic identification cards have proved to be particularly unsuitable in that it is relatively easy to forge them due to their relatively simple construction, which is equipped with authenticity features only conditionally. The printing being directly accessible, the personalization data are exposed to any attempted falsification without much protection to speak of.

German Pat. No. 29 07 004, taking such aspects of security and production technology into consideration, discloses an identification card with a card inlay of paper and a transparent cover film. The personal data are inscribed in the card inlay by means of a laser beam after lamination of the cover film. This information can be burned into the inlay or else be present in the form of a color change in a thermosensitive coating applied to the paper inlay.

Along with the advantage that this kind of identification card can have its construction completed before personalization and that it is possible to provide such a completed, laminated card with the necessary information centrally or decentrally, this kind of identification card also offers a high degree of protection against attempted forgery and falsification, since its data are protected against direct access by the cover film.

If the personalization data are burned into the inlay, a so-called "translucent effect" is obtained depending on the intensity of the writing, i.e. the data are more or less clearly visible on the back of the identification card as well. This allows for verification of the personalization data in a particularly simple manner (transmitted light testing from the back of the card). In various cases, however, this may be regarded as a disadvantage or undesirable due to a certain impairment of its visual appearance.

Since the information is burned into the paper inlay, the quality of the writing also depends on the superficial structure of the identification card material, which may be troublesome in the case of a very sturdy superficial structure.

The problem on which the invention is based is therefore to provide an identification card in which the above-mentioned advantages are retained but any card cores of plastic or paper may be used, and the aspects possibly regarded as disadvantageous in the use of paper inlays are avoided.

BRIEF SUMMARY OF THE INVENTION

This invention comprises a multilayer identification card adapted to be imprinted with visible information by a laser recorder (the information, for example, comprising patterns, letters, numbers, pictures and the like), the card including a printed core layer to which is laminated a laser transformable synthetic film layer which is transparent in the visible range but absorbent to the laser recorder light beam of selected wave lengths and which undergoes visible local changes of optical characteristics due to transformation of the film material upon exposure to the laser recorder light beam. The card may further include an inlay layer that also is capable of receiving and optically displaying information imprinted thereon by the laser recorder. The laser preferably is a Nd:YAG laser, transmitting in the near-infrared spectral region of 1064 nm.

In accordance with the present invention, an identification card contains a paper or plastic core which is laminated between two transparent cover films. The cover films may be single- or multilayer, although at least one layer of the film is made of a laser transformable material which is transparent in the visible wave range and sufficiently absorbant in the wave range of a laser recroder.

However, all embodiments have in common that the information exists in the form of local changes in the optical properties of the laser transformable cover film, resulting from the local transformations in the cover film material caused by a laser beam from a laser recorder. Depending on the dosage of laser beam energy, processes are triggered in the laser transformable cover film whose exact chemical development has not yet been sufficiently researched. It is thought, however, that transparent cover films made of hard PVC which particularly well absorb the light of an Nd:LAG laser working in the very near infrared spectral region, are locally transformed and partially destroyed in their material structure, in the course of which discoloration takes place due to gases, elementary carbon and other chemical reactors being released, which have not yet been examined more closely. When the dosage of laser energy is small, microscopically fine gas bubbles and black, microscopically small points presumably consisting of elementary carbon, first arise locally in the dye. At this stage the information is already visible to the naked eye as a dim shadow. When the laser energy is increased, the gas formation and blackening in the laser transformable film also increase until, at a certain laser energy depending on the properties of the film, a blackened channel consisting of more or less cohesive gas bubbles that are clearly defined locally is formed in the film, closed off on the card surface side. At this stage the information is already very clearly visible. When the laser energy is increased further, the channels break open so that a blackened groove which opens onto the card surface is formed, on the edge and surface of which other color reactions are observed which may modify the overall color effect.

By varying the dosage of the laser energy and changing the "exposure time", all transitional steps between the above-mentioned stages may be selectively attained, each resulting in a somewhat different overall appearance of the inscribed information. This method is characterized, however, by the especially fine, clearly marked and precise writing peculiar to all the identification cards produced in accordance with the invention.

The laser transformable cover film which is more or less transparent in the visible wave range, according to its thickness (the thin films conventionally used in laminating technology are completely transparent in their laminated state), should have, in the wave range of the laser recorder to be used, a linear absorption coefficient which is only about a factor of one to two powers of ten greater than that of conventional cover films of comparable thickness without this absorptive behavior specifically adapted to laser recorders. Greneral cover films which are also transparent a laser recorder, are also used as well in identification cards having paper inlays which can be written on through the cover films.

In a development of the invention, if, for example, a more or less opaque or tinted appearance is intended for the identification card, the thickness of the film may be increased or the film material compounded with substances which bring about such an effect, e.g. small amounts of colored pigments. The tint or opaque effect may be controlled by these two parameters, the addition of pigments and the film thickness, up to the point that almost the entire transparency range is covered, i.e. identification cards can be produced in which the printing on the inlay is barely visible (almost opaque cover films) as well as identification cards in which it is very clearly visible (completely transparent cover films).

Protection against forgery may also be increased by burning the information onto an inlay provided in the card through the cover film or films, having chosen the film thickness and dosage of laser recorder energy in such a way that the information is present both in the laser transformable cover film and on the inlay. In this way any attempted forgery which aims at detaching and exchanging the cover films, which is very difficult and hardly feasible anyway, is rendered utterly impossible.

A further advantage of the inventive method is that completely transparent areas can also be written on. In a special embodiment, for example, a window formed of the laser transformable cover film material can be provided in the card core so that this area is completely transparent or, as mentioned above, more or less transparent or opaque after lamination. Information can then be inscribed in this window in the form of patterns, numbers, letters and/or pictures by means of a laser recorder. Since the writing produced in the cover films by means of laser recorders differs from other writing in its characteristic microstructure, one thus attains another authenticity feature which is easy to test visually, in addition to the fact that "laser data" are present in transparent film areas.

Further embodiments and details of the method shall be discussed in more detail with reference to the drawings appended hereto.

DETAILED DESCRIPTION OF THE INVENTION

Figure 1:
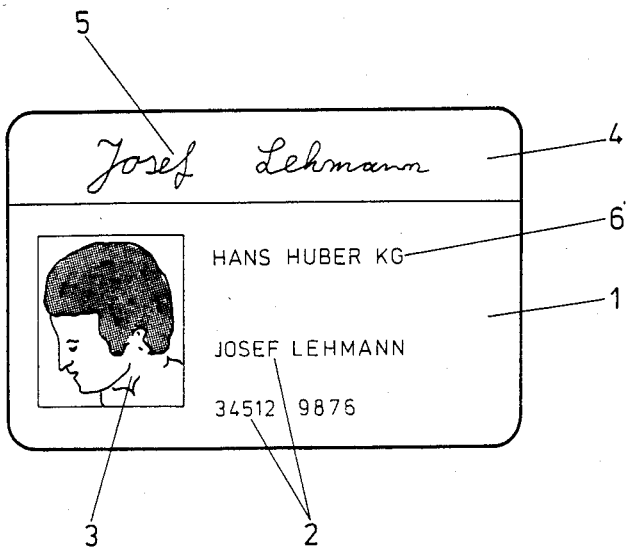
FIG. 1 shows a top view of an identification card made in accordance with this invention.

FIG. 1 shows an identification card 1 with personalization data 2, a photo 3, printing 6 on a paper or plastic inlay and a signature stripe 4 provided with a signature 5 applied by the card owner himself. While the company name 6 is preferably printed on the paper or plastic inlay, the personalization data 2 and possibly the photo 3 as well are inscribed by means of a laser recorder in the cover film which is a synethetic film material that is transparent in the visible wave range but absorbant in the wave range of a laser recorder, for example a Nd:YAG laser emitting in the very near infrared spectral region with a wavelength of 1064 nm.

A laser responsive cover film material suitable for this method is, for example, a hard PVC film termed ALKOR-PLAST CC-00-013 (called ALKOR film in the following) of the ALKOR Company of Munich, which has a linear absorption coefficient K at a thickness of 0.094 mm which at a wavelength of 1064 nm is approx. 15 times greater than a hard PVC film conventionally used in laminating technology, e.g. of the SICOVINYL CC/L RU type of the Mazzuchelli Company of Varese, Italy, with a thickness of 0.283 mm.

As has been shown in experiments, the inventive reaction only comes about in the laser responsive film above a certain threshold. This threshold can only be exceeded by relatively high laser beam energy which is only possible in continuous operation in the case of high-power lasers. The above-mentioned relatively inexpensive Nd:YAG laser does not exhibit in continuous operation enough margin of power to overcome the power threshold. However, if the laser is operated in pulses to write on ALKOR films, the half-width value of a pulse being 200 ns and the power maximum of a pulse being around 20 kW, this threshold can be exceeded to obtain the inventive effects. The power maximum of a pulse can also be shifted up and down to obtain various effects which shall be described in more detail in the following.

Figure 2:
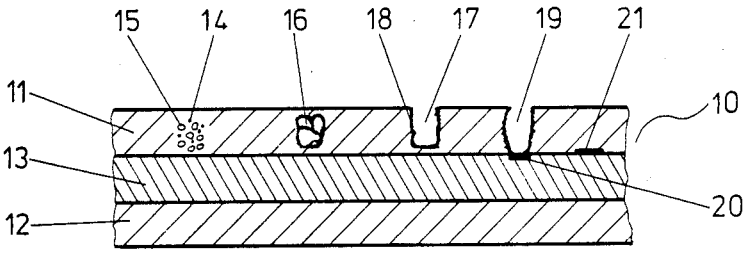
FIG. 2 is a schematic cross-sectional view of an identification card made in accordancw with the invention.

FIG. 2 shows a cross-section of a representative multilayer identification card 10 made in accordance with the invention. The card inlay 13 is made of plastic or is designed as a security and is laminated between two ALKOR laser transformable films, cover films 11, 12. Whereas the general, card-independent information 21 (similar to printing 6 in FIG. 1) is printed on the card inlay 13, the card-specific personalization data 2 (FIG. 1) are produced by local changes in the optical properties of the laser transformable cover film material 11 resulting from characteristic material transformations 14–20 in the cover film material 11 dependent upon the energy dosage of the laser beam.

Different effects in the laser transformable film material can be obtained selectively according to the dosage of the laser energy. The reactions begin to snowball above a certain threshold. When the threshold is exceeded, microscopically fine bubbles 15 and microscopically fine black points 14 first form in the film, which are probably decomposition products of the PVC material, such as released gases and elementary carbon. The information is already visible to the naked eye at this stage as dim shadows in the cover film 11.

When the laser energy supply is increased, the bubble formation and blackening increase, and a clearly visible channel 16 is formed in the film which is well marked locally, is closed off on the card surface side of the film and consists of more or less cohesive bubbles which are more or less blackened on their surfaces.

When the laser energy supply is increased further, channel 16 breaks open so that a channel 17 is formed in the film which opens out onto the card surface and whose surface 18 scatters greatly and exhibits greatly blackened areas. The information is now not only very clearly visible in cover film 11 but can also be felt and tested by hand on the card surface.

If the laser energy supply is increased even further, cover film 11 is burned through, so that not only is a channel 19 penetrating cover film 11 formed, but discolored areas 20 are also formed on the surface of card inaly 13, so that the information is present both in cover film 11 and on card inlay 13, which must be recognized as an additional increase in the protection of the information against forgery.

Figure 3:
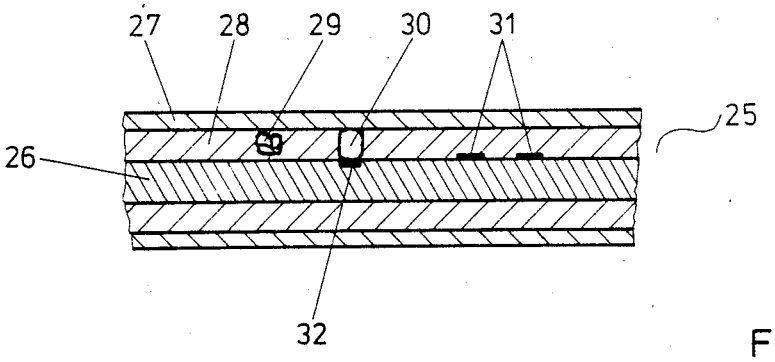
FIG. 3 is a schematic view of an alternate embodiment of an identification card made in accordance with the invention.

A further representative example of an inventive identification card is shown in FIG. 3. In this embodiment, a card inlay 26 designed as a security or made of plastic is laminated between two-layer cover films 27, 28. Imprinted information 31 like 6 and 21 in FIGS. 1 and 2 appears on the inlay 26. Layer 28 of the two-layer cover film is a laser transformable film transparent in the visible wave range but transformable when exposed to the laser recorder beam (e.g. an ALKOR film). Layer 27 is transparent both in the visual range and is transparent (non-transformable) to the laser light beam.

When writing takes place by means of the laser recorder, its energy penetrates the transparent upper layer 27 practically unimpeded and enters transformable film layer 28 where it triggers the above-mentioned reactions depending on its dosage. The information is then present in the layer 28 in the form of closed off, blackened channels 29, 30, and is also fixed in card inlay 26 in the form of discolored areas 32 when the energy dosage is higher. The advantage of this embodiment is that the surface of card layer 27 is not affected by the laser beam so that the excellent surface quality of the PVC laminated films is retained.

Figure 4:
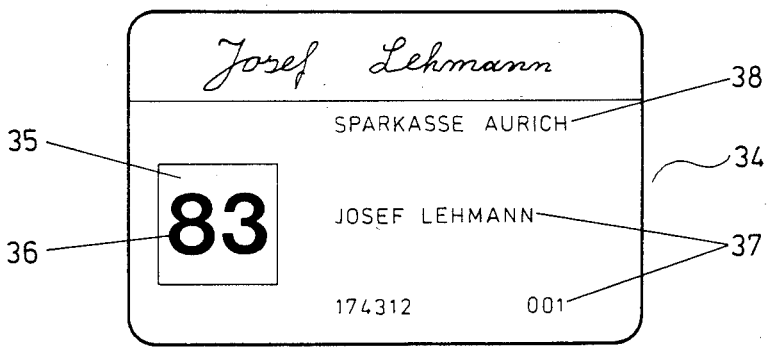
FIG. 4 is a top view of another embodiment of an identification card made in accordance with the invention.

FIG. 4 shows a further embodiment of an inventive identification card. Identification card 34 exhibits, in addition to printing 38 on the card inlay and the information 37 applied according to the invention, a transparent display window 35 in which further information 36 is entered by means of the laser recorder.

Window 35 is produced, for example, by punching out a recess in the card inlay and filling it with a completely transparent, tinted or more or less opaque material, e.g. by inserting a piece of film of an appropriate size before lamination. The card inlay and the filler are then laminated between two transparent cover films similar, for example, to laser transformable films 11 and 12 of FIG. 2. The filler can be the same material as that of the cover films (e.g. an ALKOR film) or else a material not showing the inventive effect. When the card inlay is thin, one can do without filling up the punched out window 26 so that only the material of the laser transformable cover films is found in this area after lamination.

As already mentioned above, laser transformable cover films may also be used which are tinted by the addition of suitable substances or have an opaque appearance. It is only essential that they are absorbant in the wave range of the recording laser and are at least transparent enough in the visual spectral range so that information or patterns underneath the cover films remain recognizable through the latter.

In a special embodiment of the invention, photo 3 in FIG. 1 can also be produced in the laser transformable cover film by means of the laser recorder. The photo is formed by single scanning points which are "put into" the cover film by means of a grid technique using the laser recorder in the same way as the other individual personalization data are applied. The advantages of this method are particularly apparent in this case, since not only especially fine and clear printing, but also precisely defined, small and clean density points can be obtained in the cover film. Many other embodiments are conceivable which are also based on the basic idea of the invention, i.e. the application of information in the form of numbers, letters, patterns and photos in films of varying thickness and with different tints and degrees of opacity which are transparent in the visual range but absorbant in the wave range of the laser. Even a transparent identification card having a photo and information both applied in the inventive manner is conceivable within the scope of the invention.

We claim:

1. A multilayer identification card bearing visible information thereon obtained by exposure to the beam of a laser recorder of selected wavelength, comprising:

a core layer imprinted with visible indicia on at least one surface thereof;

a laser transformable film layer overlying said indicia and laminated to the core layer, the laser transformable film layer having opposed surfaces including a surface facing towards said core layer and an opposed outer surface opposite to said surface facing towards the core layer, and being transparent to visible light and physically and optically transformed by absorption of selected wavelength laser recorder energy to produce a visible image within the film layer at least between its surfaces and not beyond said surface facing towards said core layer by local changes in the physical and optical characteristics of the laser transformable film, the laser transformable film layer being physically and optically transformed by laser energy without the laser energy effecting a corresponding imprint or transformation on the core layer.

2. An identification card as claimed in claim 1, said laser transformable film layer comprising a cover film for an entire surface of the core layer on which the visible indicia is imprinted.

3. An identification card as claimed in claim 1, wherein said laser transformable film layer is physically transformed by the formation within the film layer of visible gaseous bubbles as a result of said film layer being subjected to laser recorder energy.

4. An identification card as claimed in claim 1, wherein said laser transformable film layer is physically transformed by the formation within the film layer of discolored channels closed at the outer surface of the film layer as a result of said film layer being subjected to laser recorder energy.

5. An identification card as claimed in claim 1, wherein said laser transformable film layer is physically transformed by the formation within the film layer of discolored channels open at the outer surface of the film layer as a result of said film layer being subjected to laser recorder energy.

6. An identification card as claimed in claim 1, wherein said laser transformable film layer is physically transformed by the formation within the film layer of discolored grooves closed at the outer surface of the film layer and gaseous bubbles of varied cohesiveness within the film layer as a result of said film layer being subjected to laser recorder energy.

7. An identification card as claimed in claim 1, wherein said laser transformable film layer is physically transformed by the formation within the film layer of discolored channels open at the outer surface of the film layer, said channels including greatly scattered surfaces, each of the channels including a bottom and side edges, with the discoloration being displayed at said bottom and side edges of the channel as a result of said film layer being subjected to laser recorded energy.

8. An identification card as claimed in claim 1, said laser transformable film layer tinted by pigmentation to produce a visible color and to reduce the visible light transmittance of the laser transformable film layer.

9. An identification card as claimed in claim 1, including a laser recorder generated image within said laser transformable film layer, said image comprising a photo image produced by the laser recorder.

10. An identification card as claimed in claim 1, wherein said selected wavelength laser recorder energy is Nd:YAG laser beams having a wave length of 1064 nm.

11. An identification card as claimed in claim 1 or 10, including a second layer of film overlying at least a portion of said core layer and laminated thereto, said second layer of film being transparent both to visible light and to said selected wavelength laser recorder energy.

12. An identification card as claimed in claim 1, said core layer being opaque and including an aperture forming a display window in the core layer; said laser transformable film layer overlying said window, said image being produced in the film layer in the area of said window.

13. A process for making laser generated images on a laminated, multilayer identification card comprising:

imprinting a core layer of the card with visible indicia;

laminating a laser transformable film layer over the imprinted core, the laser transformable film layer being transparent to visible light but locally physically and optically transformable when exposed to the beam of a laser to produce local visible effects between the film surfaces when it is exposed to the laser beam;

driving the laser in a pulsed mode and exposing the laser transformable film layer to the pulsed laser beam to produce discrete visible film transformation areas within the film at least between its surfaces while not effecting a corresponding imprint or transformation on any other card layer.

14. A process as claimed in claim 13, including using a Nd:YAG laser that emits a beam of wave length 1064 nm to generate the said discrete visible film transformation areas in the laser transformable film layer.

15. A process as claimed in claim 13, wherein the laser is a Nd:YAG laser, and including driving the laser so that the half-width of each pulse is 200 ns and the maximum power level of a pulse is approximately 20 kW.

16. A process as claimed in claim 15, including driving the laser so that the power level of the pulses are varied to produce varying local visible effects within the laser transformable film layer.

* * * * *